US007975639B2

(12) United States Patent
Bishop

(10) Patent No.: US 7,975,639 B2
(45) Date of Patent: Jul. 12, 2011

(54) FLOAT FOR USE IN WATER-BASED SECURITY SYSTEM

(75) Inventor: Justin Bishop, West Caldwell, NJ (US)

(73) Assignee: Halo Maritime Defense Systems, Inc., Andover, MA (US)

( * ) Notice: Subject to any disclaimer, the term of this patent is extended or adjusted under 35 U.S.C. 154(b) by 873 days.

(21) Appl. No.: 11/879,272

(22) Filed: Jul. 16, 2007

(65) Prior Publication Data

US 2010/0029151 A1 Feb. 4, 2010

Related U.S. Application Data

(60) Provisional application No. 60/831,119, filed on Jul. 14, 2006.

(51) Int. Cl.

| | |
|---|---|
| ***B63G 9/00*** | (2006.01) |
| ***B63G 9/04*** | (2006.01) |
| ***F41H 11/05*** | (2006.01) |
| ***B63B 22/00*** | (2006.01) |
| ***B63B 22/16*** | (2006.01) |

(52) U.S. Cl. ..... 114/241; 114/240 E; 441/1; 441/133

(58) Field of Classification Search ... 114/240 R–240 E; 441/1, 6, 133; 405/26–35, 211; 256/13, 256/23

See application file for complete search history.

(56) References Cited

U.S. PATENT DOCUMENTS

| | | | | |
|---|---|---|---|---|
| 1,333,238 | A * | 3/1920 | Bassett et al. | 114/240 E |
| 1,353,811 | A * | 9/1920 | Muncy | 114/240 E |
| 2,170,481 | A * | 8/1939 | Howe et al. | 114/240 R |
| 2,383,095 | A * | 8/1945 | Wallace | 114/241 |
| 2,391,059 | A * | 12/1945 | MacFarren | 114/267 |
| 2,546,956 | A * | 3/1951 | Yeomans | 441/29 |
| 2,716,959 | A * | 9/1955 | Betts, Jr. et al. | 114/241 |
| 6,591,774 | B2 * | 7/2003 | Metherell et al. | 114/241 |
| 7,001,233 | B2 * | 2/2006 | Gotell | 441/1 |
| 7,214,114 | B2 * | 5/2007 | Gibson | 441/133 |

OTHER PUBLICATIONS

International Search Report issued in International Patent Application No. PCT/US2007/016131, mailed Jan. 22, 2009.

* cited by examiner

*Primary Examiner* — Ajay Vasudeva
(74) *Attorney, Agent, or Firm* — McDermott Will & Emery LLP

(57) ABSTRACT

Embodiments of this invention describe a float for use with a running gear entanglement system (RGES) deployed on water, in addition to an improved system and method for using an RGES deployed in water. The floats lock securely onto the RGES mainline rope. The floats may be stacked for additional buoyancy or to allow for multiple RGES ropes in the same deployment. The floats are designed to permit the RGES to be retrieved/stored on and deployed from a reel. The floats may be constructed of any color and may also be luminescent. The floats may be ballasted to assist in anchoring the RGES.

6 Claims, 3 Drawing Sheets

FLOAT FOR USE IN WATER-BASED SECURITY SYSTEM

CROSS REFERENCES TO RELATED APPLICATIONS

This application claims the benefit of U.S. Provisional Application Ser. No. 60/831,119, filed 14 Jul. 2006, the contents of which are hereby incorporated by reference herein in their entirety.

FIELD OF THE INVENTION

Embodiments of this invention include using floats with a security system/barrier deployed on water, and more particularly, for use with a security barrier of the type known as "running gear entanglement system" and describe an improved apparatus and method for this purpose.

COUNTERING TERRORISM

This invention may be utilized in countering terrorism. Unwelcome objects, such as boats, attempting to intrude into populated, secure, or sensitive areas are commonly employed in terrorist activities. As part of efforts to counter terrorism, there is an urgent need to prevent penetration of such objects into such populated, secure, or sensitive area. One or more embodiments of this invention will aid in this prevention.

BACKGROUND OF THE INVENTION

This invention concerns using floats with a security system/barrier deployed on water of the type known as "running gear entanglement system" ("RGES").

In recent years, security agencies, such as the United States Coast Guard, have been looking for ways to deter water-borne terrorist attacks. To this end, one newly developed law enforcement tool are nets designed to tangle the running gear of boats entering restricted waters.

The nets are commonly known as a "running gear entanglement system" or "RGES".

The RGES is typically a line that floats on the surface of the water, with 40-inch long loops spaced every 8 inches. Inflatable 15-inch buoys are placed approximately every 100 feet. Lights may also be attached approximately every 100 feet, midway between the flotation buoys. Anchoring systems may be required every 200 feet.

The RGES would be used primarily to temporarily cordon off a section of harbor or bay. The RGES would function analogously to the yellow tape police use on land.

An RGES may be used to help protect large gatherings such as a political convention, conference, or sporting event. The RGES would be used to provide a barrier around a high value asset or to establish a "line of demarcation", thereby outlining a security or safety zone and allow security forces sufficient time to react and counter a threat.

The RGES could operate in typical harbor, anchorage, and wharf environments including fresh, salt, and brackish waters, in air and water temperatures and thermoclines, as would typically be expected in a port/harbor environment.

Thus, one concern of the use of an RGES is its environmental impact. Depending on where the nets are used, turtles, manatees, sea lions and other aquatic life might become snarled. Although tests to date have concluded that the nets won't harm wildlife, concern does continue.

Therefore, it is desired to maximize the efficiency of an RGES with minimal effect, if any, on the surrounding environment.

BRIEF SUMMARY OF THE INVENTION

In one embodiment, this invention comprises a float for use with an RGES.

In another embodiment, this invention comprises a method for using a plurality of floats with an RGES.

In still another embodiment, this invention comprises apparatus using a plurality of floats with an RGES.

DETAILED DESCRIPTION OF THE INVENTION

Figure 1:
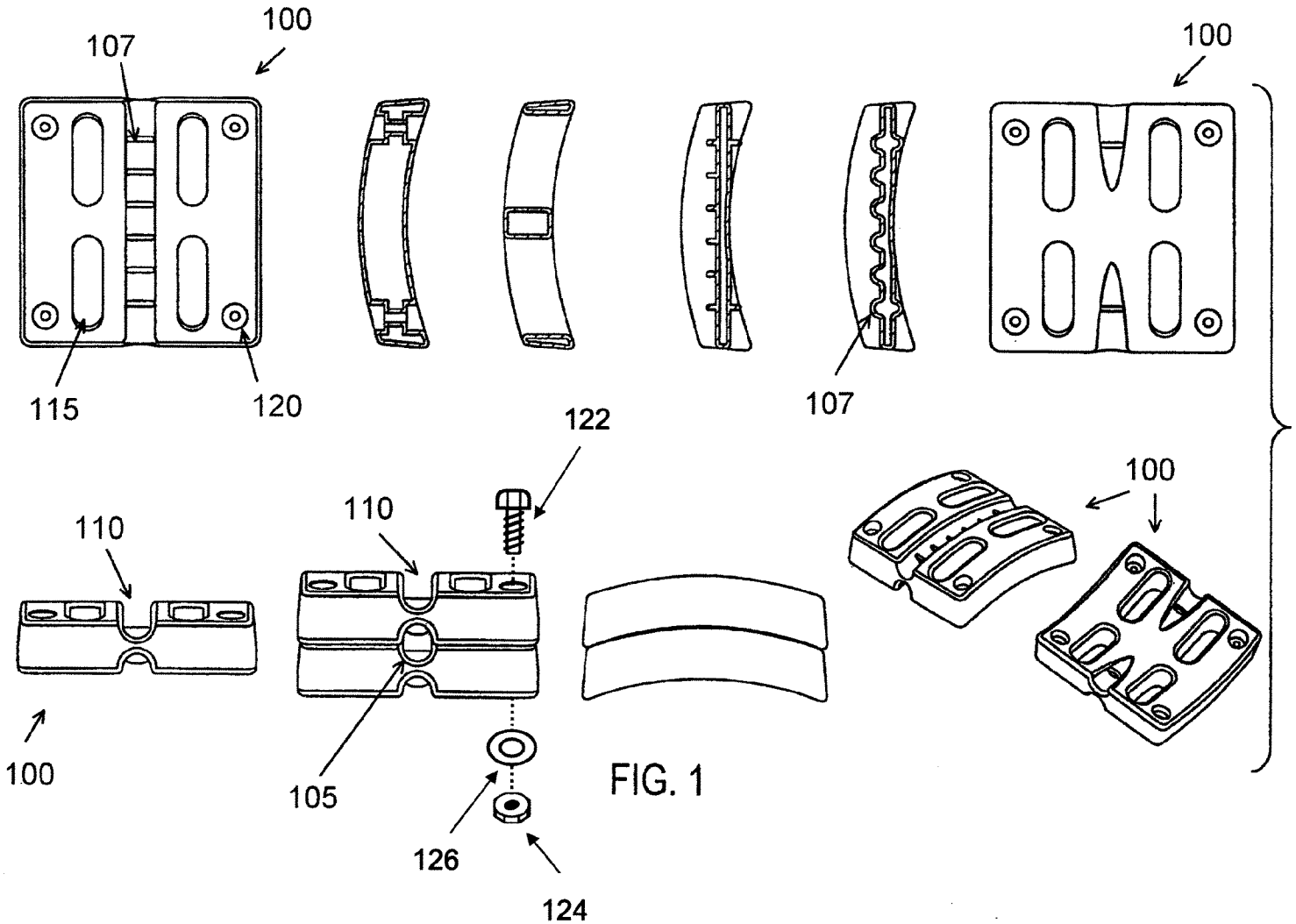
FIG. 1 is a view of one embodiment of this invention.
Figure 2:
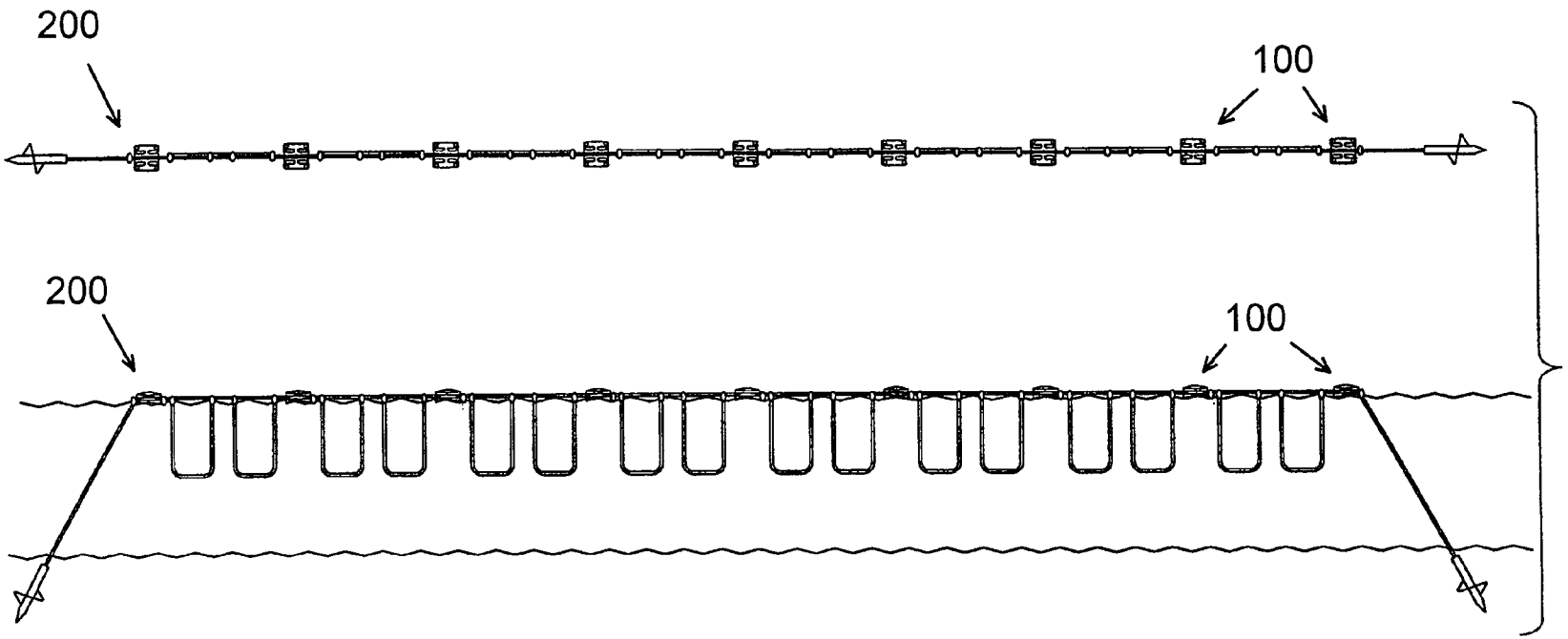
FIG. 2 is another view of one embodiment of this invention.
Figure 3:
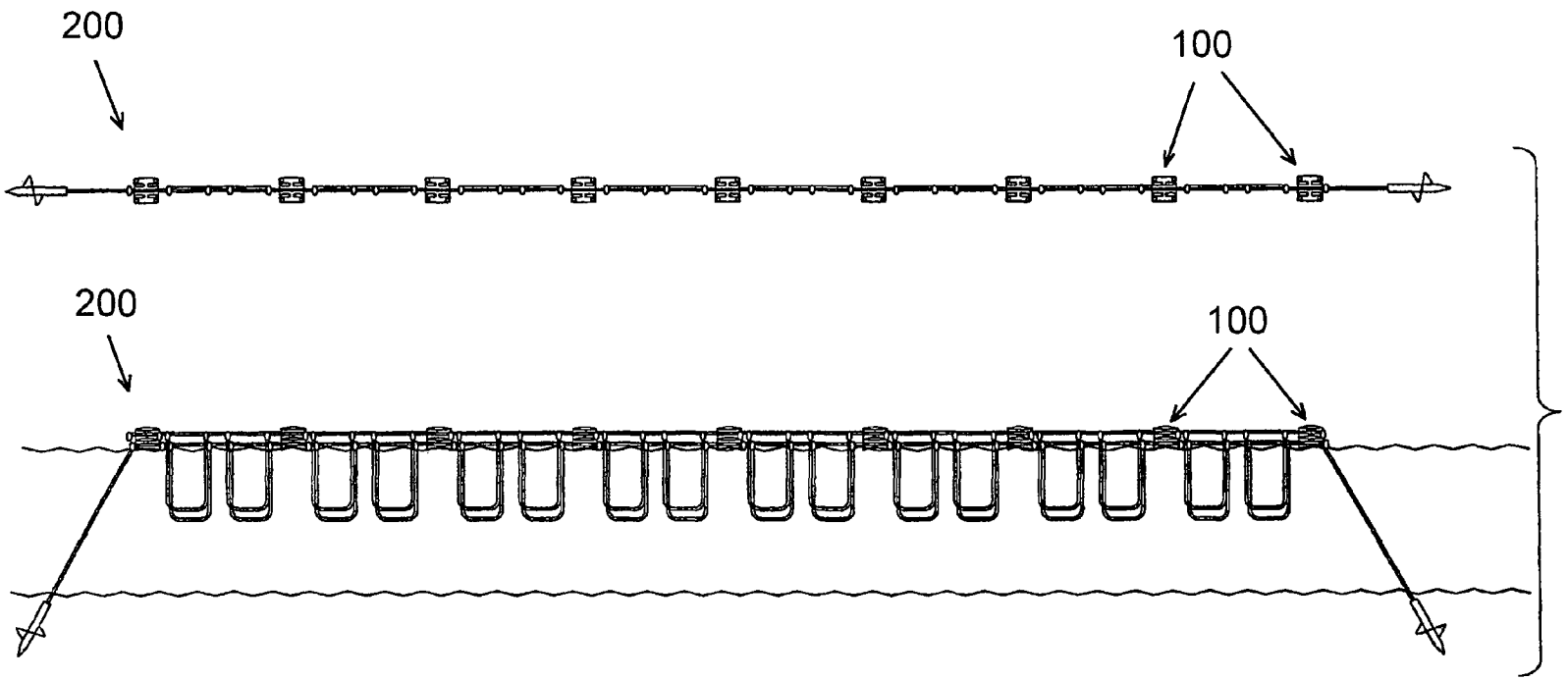
FIG. 3 is another view of one embodiment of this invention.

In a preferred embodiment of this invention, a float 100 is described for use with an RGES 200.

The float 100 is preferably made of polyethylene, although any, lightweight, moldable, buoyant material may be used. The float 100 has a modular design to allow stacking and securing multiple floats on top of each other.

The float 100 has a locking mechanism 105 to allow attachment to the RGES rope. This locking mechanism 105 is comprised of raised ridges 107 in the underside of the float. These ridges 107 act in conjunction with a groove 110 on the dorsal area of the float 100, allowing a uniform compression of any given diameter rope. This system has the effect of locking the float 100 in position on the rope.

The float contains apertures 115 to reduce or eliminate heave forces on the RGES system when deployed. The apertures 115 also are used for hand holds to assist in retrieval of the system from the water.

Individual floats 100 may be stacked one upon the other as desired. The floats 100 are held one upon each other by attachment means 120 well known in the art, including, without limitation, bolts 122, nuts 124, and/or washers 126. Preferably, attachment occurs at the four corners of the float. The fasteners also create an opportunity to mount warning devices and sensors above and below the water.

In use, a plurality of floats 100 are locked onto a RGES mainline rope via the locking mechanism. Preferably, pairs of two stacked floats 100 are placed approximate six feet apart along the RGES mainline rope, but the stacking and placement combinations may be adjusted for any particular application.

The floats 100 provide a method of delineation for ropes floating in the water. Also, the floats 100 provide additional buoyancy for the RGES 200. This additional buoyancy increases the propeller-catching capabilities of the RGES 200.

Another embodiment of this invention comprises utilizing a plurality of floats to increase the number of RGES systems deployed in a given usage. This outcome may be accomplished by stacking floats on top of each other and locking individual RGES lines to different, corresponding floats in each stack. For example, with a series of four-stacked floats, one could locking one RGES line in the second lowest float of each stack and another RGES line in the uppermost float of each stack. The resulting RGES system would have increased propeller-catching capabilities.

Furthermore, the float may have a shape and design specifically chosen to allow an RGES system including locked-on floats to be stored or rolled onto a reel. This reel-friendly characteristic permits for easy deployment and retrieval of an RGES system.

In addition, the float may incorporate additional safety features, including, without limitation, being of any desired color and/or luminescent to glow in the dark.

Another embodiment of this invention comprises a series of floats deployed along an RGES system in a drogue configuration slowing the motion. These configurations, well known in the art, would have the beneficial effect of slowing down a vessel which comes into contact with the RGES system.

Still another embodiment of this invention comprises ballasting a series of floats. Such ballasting, utilizing methods well known in the art, would allow the floats to assist or act as an anchor for the RGES system, other netting, or other lines in the water column.

Therefore, although this invention has been described with a certain degree of particularity, it is to be understood that the present disclosure has been made only by way of illustration, and that numerous changes in the details of the apparatus and method may be resorted to without departing from the spirit and scope of the invention.

I claim:

1. A float in a running gear entanglement system (RGES), said running gear entanglement system including a rope that floats on the surface of water, the float comprising:

a float body having an arcuate shape;

an aperture disposed on the float body;

an attachment portion disposed on the float body for connecting and stacking the float with another float; and a groove formed on a surface of the float body for providing a locking mechanism to lock the rope of the RGES when the float is stacked with the another float, the groove having a plurality of raised ridges disposed on a bottom of the groove.

2. The float of claim 1, wherein the float is made of polyethylene.

3. A running gear entanglement system (RGES) comprising:

a pair of stacked floats, each being the float of claim 1, attached to the rope of the RGES.

4. The running gear entanglement system of claim 3, wherein the pair of stacked floats are connected by at least one of bolts, nuts and washers at the attachment portion.

5. The running gear entanglement system of claim 3, wherein the RGES includes a plurality of pairs of the stacked floats.

6. A method for constructing a running gear entanglement system (RGES), the method comprising the step of:

stacking two floats, each being the float of claim 1;

locking the rope of the RGES by the stacked floats for incorporating the floats into the RGES.

* * * * *